US005161690A

United States Patent [19]

Foshaug

[11] Patent Number: 5,161,690

[45] Date of Patent: Nov. 10, 1992

[54] PARALLELLEPIDEPIC TRANSPORT CONTAINER

[75] Inventor: Olav Foshaug, Bardu, Norway

[73] Assignee: Dynoplast A/S, Sjovegan, Norway

[21] Appl. No.: 828,226

[22] Filed: Jan. 30, 1992

[51] Int. Cl.[5] ..... B65D 21/02

[52] U.S. Cl. ..... 206/512; 220/DIG. 6; 220/571

[58] Field of Search ..... 206/512; 220/DIG. 6, 220/571

[56] References Cited

U.S. PATENT DOCUMENTS

| | | | |
|---|---|---|---|
| 2,702,647 | 2/1955 | Wesling | 206/512 |
| 3,628,684 | 12/1971 | Sere | 206/512 |
| 3,878,980 | 4/1975 | Crane | 206/512 |
| 4,386,700 | 6/1983 | Deaton | 220/DIG. 6 |
| 4,880,156 | 11/1989 | Wallet | 220/DIG. 6 |
| 4,911,303 | 3/1990 | Andersson | 206/512 |
| 4,930,648 | 6/1990 | Hundt | 220/DIG. 6 |

FOREIGN PATENT DOCUMENTS 2433734 7/1974 Fed. Rep. of Germany .

*Primary Examiner*—Joseph Man-Fu Moy

*Attorney, Agent, or Firm*—Cushman, Darby & Cushman

[57] ABSTRACT

A parallelepipedic transport container for moisture emitting goods, particularly fish, said container comprising side walls, end walls, a bottom wall, lifting handles and at least one bevelled substantial vertical corner face, said corner face being provided with at least one draining outlet near the bottom wall, and the lower portion of the bottom wall of said container is externally recessed for secure stacking on top of another container, wherein the recession, at least at the bottom of the at least one bevelled corner face, is formed with a drop nose and said at least one draining outlet is disposed above said drop nose of said bevelled corner face.

10 Claims, 3 Drawing Sheets

PARALLELLEPIDEPIC TRANSPORT CONTAINER

The present invention relates to a parallelepipedic transport container for moisture emitting goods, particularly fish, having bevelled corners and lifting handles.

The area of usage for such containers is primarily longdistance transport of fish, i.e., transport of fish from the unloading point for the fishing vessel to a remote destination. The dimensions of the container are designed to provide for an optimal degree of filling within a 20 and 40 feet ship container.

A major problem with such transport containers is that the fish emits moisture during the transport. This moisture problem will of course be increased if pieces of ice are placed in the container together with the fish. If adequate drainage of the transport container is not provided for, the quality of the fish—particularly that portion lying closest to the bottom—could be severely reduced. In addition, there is a tendency for water from transport containers located higher up to run down into the transport containers positioned lower down, thus further aggravating the above problem.

An additional concern with transport containers of this type is to attain sufficient stacking strength when a plurality of containers is stacked on top of one another. The handle openings, in particular, have contributed to diminished stacking strength for the containers.

The purpose of the present invention, therefore, is to provide direction for obtaining a transport container of the above mentioned type, where the cited disadvantages are avoided, so that effective drainage of liquid from the containers is provided for in a manner which prevents said liquid from running down into the container situated below, at the same time as the container exhibits good stacking strength without increasing the amount of plastic needed for the production of the container.

This is achieved according to the invention by means of a transport container of the type defined in the introduction, and having the features that are disclosed in the characterizing clause of claim 1.

By means of the features in claim 2, enhanced stacking strength is attained without the necessity of increasing the quantity of the plastic material used in the construction. Additional features of the invention are disclosed in the dependent claims 3 and 4.

The invention will be explained in more detail in the following description, with reference to the figures which show a preferred embodiment of the invention.

Figure 1:
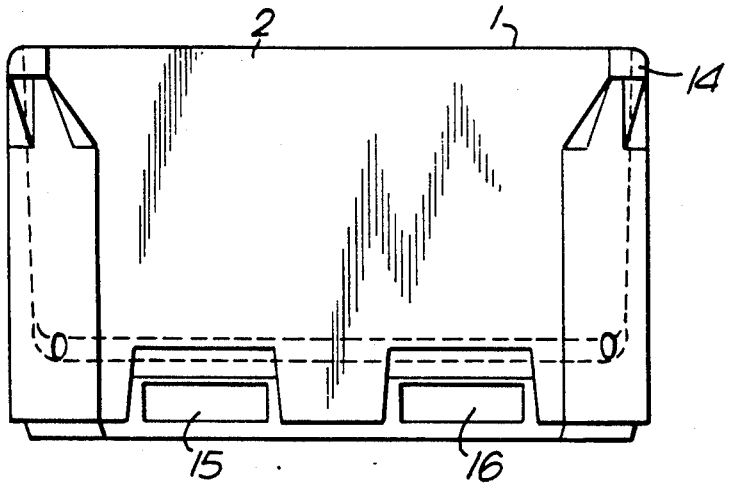
Figure 2:
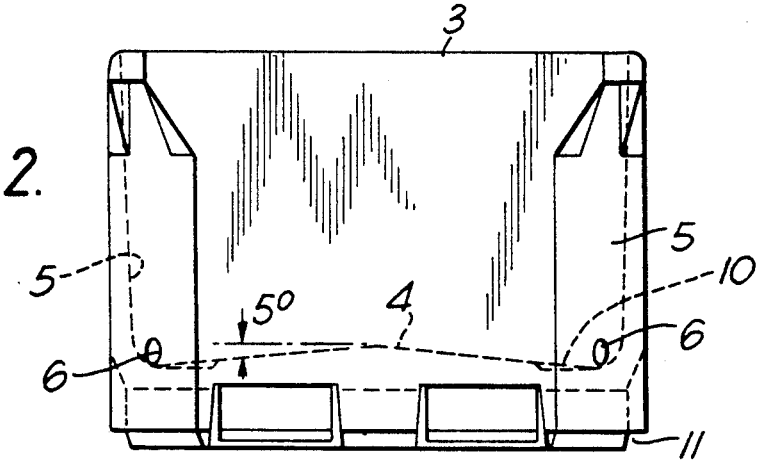
Figure 3:
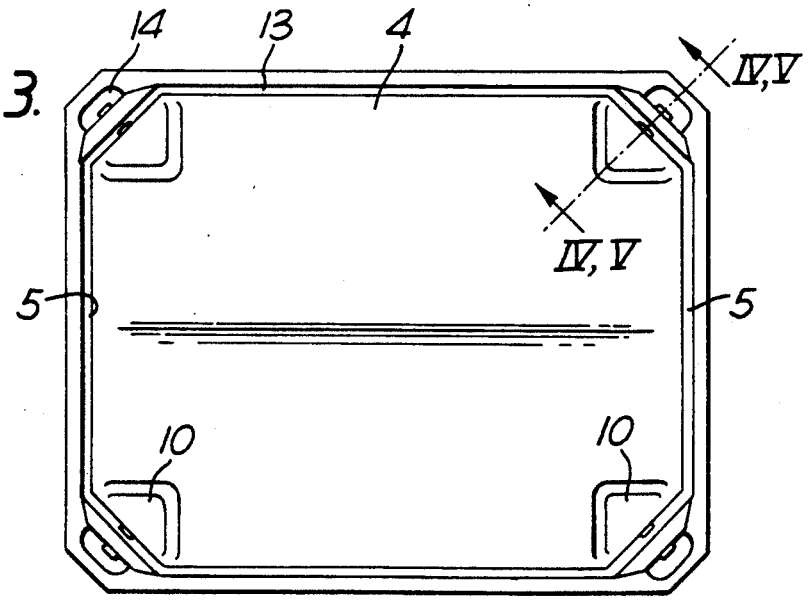
Figure 4:
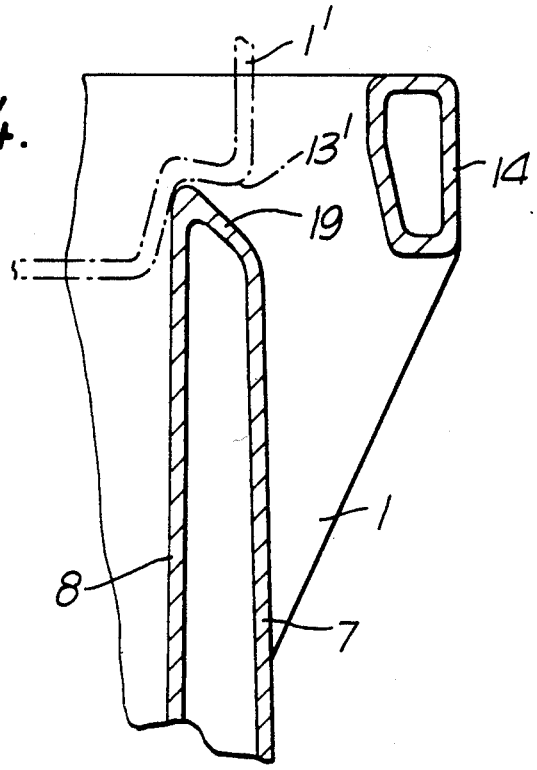
Figure 5:
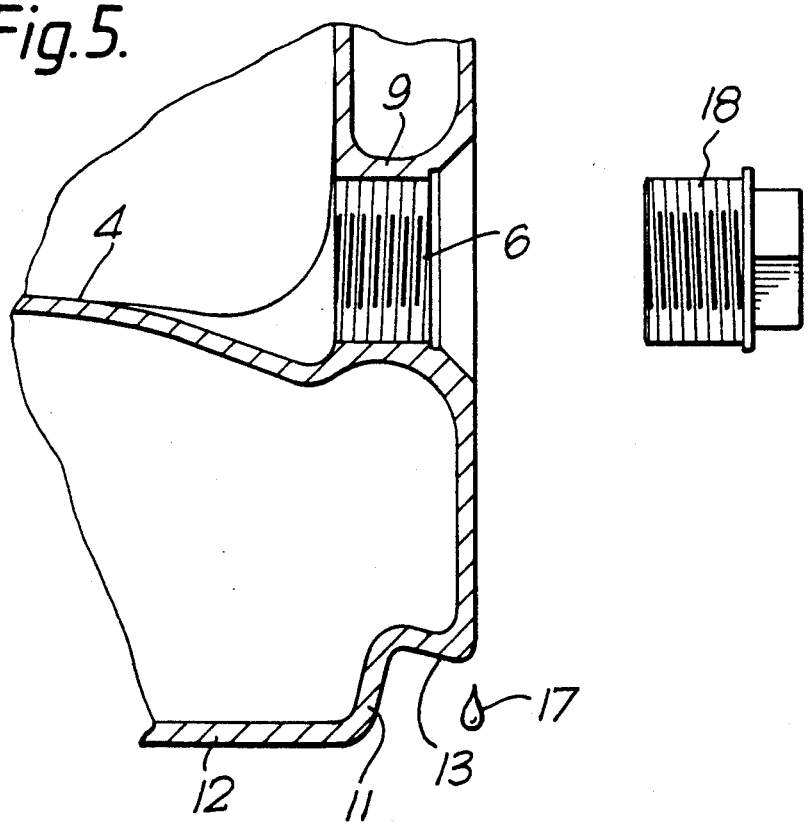
Figure 6:
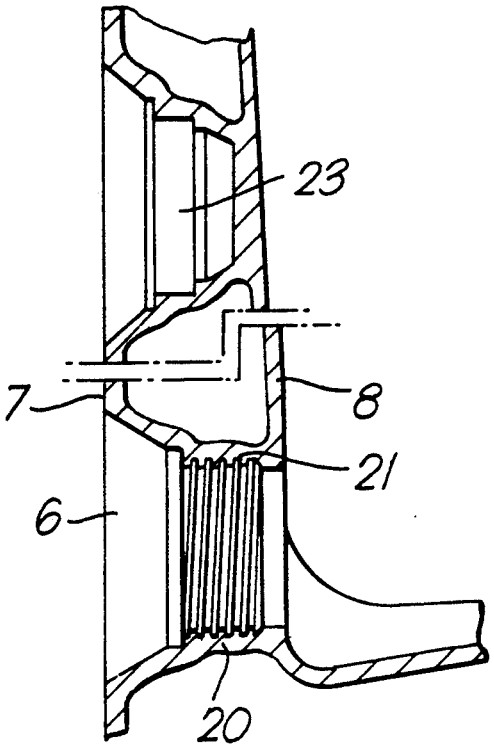
Figure 7:
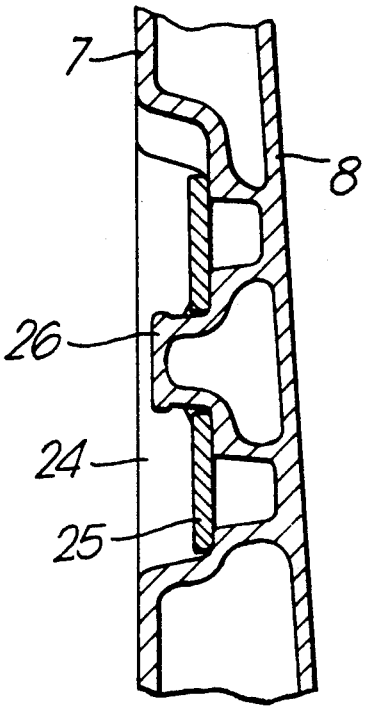
Figure 8:
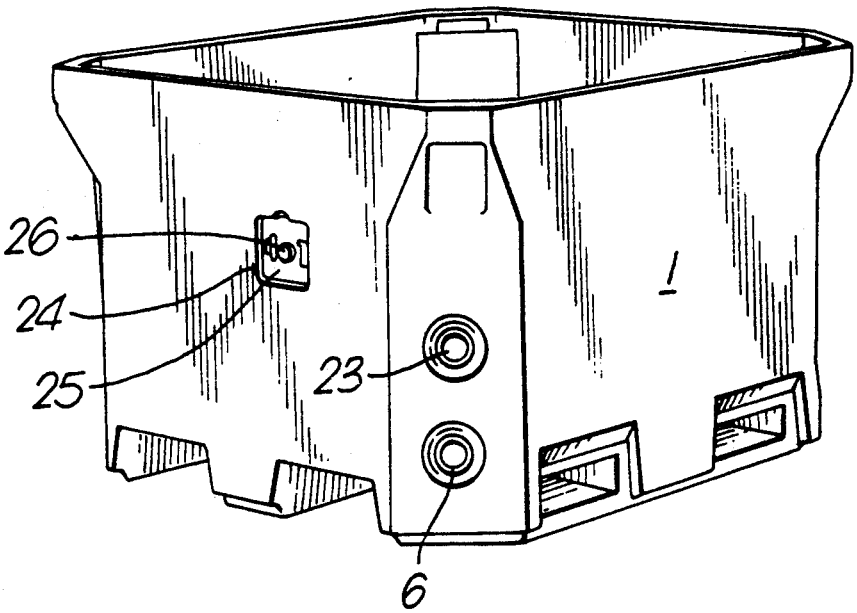

FIG. 1 is a side elevational view of the transport container according to the invention, FIG. 2 is an end elevational view of the transport container of FIG. 1, FIG. 3 is a top plan view of the transport container of FIG. 1, FIG. 4 is a cross-sectional view along line IV—IV of FIG. 3 through the upper part of a corner section, FIG. 5 is a cross-sectional view along line V—V in FIG. 3 through the lower part of a corner section, FIG. 6 is a cross-sectional view through the wall of a further embodiment of the container, FIG. 7 is a cross-sectional view through another portion of the wall of the further embodiment, and FIG. 8 is a perspective view of the further embodiment of the container according to the invention.

The transport container 1 according to the invention has a parallelepipedic form with two side walls 2 and two end walls 3 and a water-tight bottom wall 4. The container is open at the top. As is particularly apparent from FIG. 3, all of the corners are bevelled. In each of the bevelled corner faces 5, a draining outlet 6 is disposed near the bottom wall, which outlet 6 passes through the wall of the container from the inside to the outside. As is apparent from FIGS. 4 and 5, the sides and end the container have the form of double walls, with an outer wall 7 and an inner wall 8. The draining outlets 6 are formed by a sleeve 9 extending from the outer wall 7 to the inner wall 8. As is particularly apparent from FIG. 2, the bottom 4 is domed, i.e., it is convex toward the inside of the container. At each corner there is a depression 10. This domed bottom and the depressed area 10 at each corner, together with the draining outlets 6, serve to prevent the collection of any water in the bottom of the container. Thus, even if some liquid were to form inside the container by the melting of ice and/or the emission of liquid from the fish, even the lowest layer of fish would remain unsoaked in the container.

The side walls 2 and the end walls 3 are inwardly offset and recessed 11 at the bottom 12. The offset recess 11 is designed with a drop tip 13, which causes any water that might run along the outside of the container to leave the container in the form of drops 17. As is apparent from the upper part of FIG. 4, where the dotted line indicates an additional container 1' which is stacked on top of container 1, water that drips down from the drop tip 13' on container 1' will run along the outside of the container 1 situated below. Thus, no water will pass into a container from an additional container stacked thereupon. To further ensure that water will not enter the container, the walls are provided with an inclined surface 9 at the upper edge. The handles 14 at each corner are formed from portions that project outwardly from the top of the bevelled faces 5 and are in fact not a load transmitting part of the container walls. Thus, there are no handle openings in the walls which could impair the stacking strength thereof. The handles 14 are disposed in the open area of the outer wall of the container formed by the bevelled corners, and thus do not increase the exterior dimensions of the container.

The double walled bottom of the container is formed by an inner bottom wall 4 and an outer bottom wall 12 which forms a pallet section that is an integrated part of the container. In this pallet section closed fork lift insertion slots 15 and 16 are provided, so that the container may be emptied by means of a fork lift truck with a tilting disc, and not permitting the container to run off the fork fingers.

The draining outlet 6 is moulded as an integrated tubular passage and thus binds the inner and outer walls securely together and, in addition, contributes substantially to the rigidity of the corners onto which the major portion of the load is transferred.

As shown in FIG. 6 the draining outlet 6 can be formed of a sleeve 20 connecting the adjoining inner walls 8 with the adjoining outer walls 7 of the container 1. The sleeve 20 has internal threads 21 intended for insertion of the threaded sealing plug 18.

A threaded depression 23 is provided in the container wall above the draining outlet 6 for parking of the threaded sealing plug 18 when draining is effected.

In FIGS. 7 and 8 a further depression 24 in a container wall is depicted. One or more such depressions 24 can be formed in the container walls. Each depression 24 includes fastener means 26 for insertion of marking means 25 such as a daymark or tag. The tag provides information of the datum the goods were caught, type of goods etc.

The above described depressions 23, 24 and the sleeve 20 provide further strength and rigidity to the container in that the inner and outer walls of the container are interconnected at additional locations. These features increase the ability of the containers to be stacked in height with heavy loads without deforming the container.

I claim:

1. A parallelepipedic transport container for moisture emitting goods, particularly fish, said container comprising side walls, end walls, a bottom wall, lifting handles and at least one bevelled substantial vertical corner face, said corner face being provided with at least one draining outlet near the bottom wall, and the lower portion of the bottom wall of said container is externally recessed for secure stacking on top of another container, wherein the recession, at least at the bottom of the at least one bevelled corner face, is formed with a drop nose and said at least one draining outlet is disposed above said drop nose of said bevelled corner face.

2. A transport container as defined in claim 1, wherein each lifting handle is provided at the upper edge of each bevelled corner face, said lifting handle projecting outwardly from said bevelled corner face and is substantially making up the actual container corner at said upper edge, said projecting lifting handle and the adjoining side and end walls forming a drop catcher for a container disposed atop.

3. A transport container as defined in claim 1, wherein the bottom wall is upwardly domed toward the inside of said container to form a depressed area along the walls of the container and at the bevelled corner faces in order to duct liquid towards said draining outlets and further on to said drop noses.

4. A transport container as defined in claim 2, wherein the bottom wall is upwardly domed toward the inside of said container to form a depressed area along the walls of the container and at the bevelled corner faces in order to duct liquid towards said draining outlets and further on to said drop noses.

5. A transport container as defined in claim 3, wherein a further depression is provided in the bottom wall at least one of said bevelled corner faces.

6. A transport container as defined in claim 4, wherein a further depression is provided in the bottom wall at least one of said bevelled corner faces.

7. A transport container as defined in claim 1, wherein at least one of said side, end and bottom walls are a double wall formed of an inner wall and an outer wall.

8. A transport container as defined in claim 7, wherein said draining outlet is formed by a sleeve connecting the adjoining inner walls with the adjoining outer walls of said container, said sleeve having threads on its internal surface container, said sleeve having threads on its internal surface intended for insertion of a threaded sealing plug.

9. A transport container as defined in claim 8, wherein a further threaded depression is provided in the container wall for parking of said threaded sealing plug.

10. A transport container as defined in claim 1, wherein at least one of the container walls is provided with a further depression and fastener means for insertion of marking means.

* * * * *